US011845598B2

(12) United States Patent
Aretz et al.

(10) Patent No.: US 11,845,598 B2
(45) Date of Patent: Dec. 19, 2023

(54) BUNDLE COMPRISING PACKAGING SLEEVES AND AN OUTER PACKAGING

(71) Applicant: SIG Technology AG, Neuhausen am Rheinfall (CH)

(72) Inventors: Karl-Josef Aretz, Erkelenz (DE); Andreas Lemsky, Troisdorf (DE); Richard Leufen, Linnich (DE); Stefan Schnorr, Eschweiler (DE); Jörg Steinfels, Grevenbroich (DE)

(73) Assignee: SIG Technology AG, Neuhausen am Rheinfall (CH)

( * ) Notice: Subject to any disclaimer, the term of this patent is extended or adjusted under 35 U.S.C. 154(b) by 62 days.

(21) Appl. No.: 16/955,965

(22) PCT Filed: Nov. 29, 2018

(86) PCT No.: PCT/EP2018/082922
§ 371 (c)(1),
(2) Date: Jun. 19, 2020

(87) PCT Pub. No.: WO2019/120917
PCT Pub. Date: Jun. 27, 2019

(65) Prior Publication Data

US 2021/0070515 A1 Mar. 11, 2021

(30) Foreign Application Priority Data

Dec. 22, 2017 (DE) ..... 10 2017 131 262.5

(51) Int. Cl.
*B65D 71/06* (2006.01)
*B65D 85/07* (2017.01)
(Continued)

(52) U.S. Cl.
CPC ..... *B65D 71/063* (2013.01); *B65D 71/08* (2013.01); *B65D 85/07* (2018.01); *B65D 85/62* (2013.01); *B65D 2571/00148* (2013.01)

(58) Field of Classification Search
CPC ..... B65D 71/063; B65D 85/07; B65D 71/08; B65D 85/62; B65D 2571/00148;
(Continued)

(56) References Cited

U.S. PATENT DOCUMENTS 2,458,036 A 1/1949 Veitch et al.
3,458,036 A 7/1969 James
(Continued)

FOREIGN PATENT DOCUMENTS

CN 107264909 A 10/2017
CN 107264914 A 10/2017
(Continued)

*Primary Examiner* — Chun Hoi Cheung
(74) *Attorney, Agent, or Firm* — THE WEBB LAW FIRM

(57) ABSTRACT

There is illustrated and described a bundle (14) comprising packaging sleeves (10) and an outer packaging (15), comprising: a plurality of packaging sleeves (10) of a composite material, and an outer packaging (15) which surrounds the packaging sleeves (10), wherein each packaging sleeve (10) has a front side (12) and a rear side (13), wherein the front side (12) and the rear side (13) of each packaging sleeve (10) are separated from each other by means of folding edges (F), along which the packaging sleeve (10) is folded flat, wherein each packaging sleeve (10) has two openings which are arranged on opposite sides of the packaging sleeve (10), and wherein each packaging sleeve (10) has a longitudinal seam (11) which connects two edges of the composite material to form a circumferential packaging sleeve (10). In order to enable a space-saving, cost-effective and reliable transport of packaging sleeves (10), it is proposed that the outer
(Continued)

packaging (15) be produced from a plastics material film (17).

18 Claims, 7 Drawing Sheets

(51) Int. Cl.
*B65D 71/08* (2006.01)
*B65D 85/62* (2006.01)

(58) Field of Classification Search
CPC ..... B65D 5/067; B65D 3/08; B65D 5/746; B65D 5/0209; B65D 5/029; B65D 5/40; B65D 5/4266; B65D 5/064
USPC ..... 206/497, 425
See application file for complete search history.

(56) References Cited

U.S. PATENT DOCUMENTS

| | | | | |
|---|---|---|---|---|
| 4,005,777 | A * | 2/1977 | Marantz | B65B 11/585 206/497 |
| 4,700,528 | A * | 10/1987 | Bernard | B65D 71/08 53/413 |
| 5,685,428 | A * | 11/1997 | Herbers | B65D 71/0085 206/391 |
| 5,810,243 | A * | 9/1998 | DiPinto | B65D 5/4279 229/198.2 |
| 6,105,777 | A * | 8/2000 | Castellarin | F17C 13/084 206/459.5 |
| 6,139,480 | A | 10/2000 | Moss et al. | |
| 6,405,869 | B1 * | 6/2002 | Whittemore | B65D 75/002 383/86 |
| 6,554,182 | B1 * | 4/2003 | Magnusson | B65D 5/563 493/134 |
| 8,178,180 | B2 * | 5/2012 | Penttinen | B32B 27/30 53/484 |
| 10,329,395 | B2 | 6/2019 | Shih et al. | |
| 10,625,593 | B2 | 4/2020 | Gillett | |
| 10,625,893 | B2 | 4/2020 | Schaaf | |
| 10,850,887 | B2 | 12/2020 | Dammers et al. | |
| 2005/0089656 | A1 * | 4/2005 | Shiina | B65D 5/067 428/34.2 |
| 2005/0258221 | A1 * | 11/2005 | Maurer | B31B 50/84 229/103.1 |
| 2007/0045153 | A1 | 3/2007 | Bautista et al. | |
| 2008/0296359 | A1 * | 12/2008 | Kortsmit | B65D 5/067 229/187 |
| 2011/0303739 | A1 * | 12/2011 | Franic | B65D 5/067 229/125.42 |
| 2013/0067864 | A1 * | 3/2013 | Dwyer | B65B 11/10 53/449 |
| 2015/0076022 | A1 * | 3/2015 | Niedersuess | B65B 11/58 206/432 |
| 2016/0332795 | A1 * | 11/2016 | Mainz | D21H 27/10 |
| 2016/0376045 | A1 * | 12/2016 | Seiche | B65B 3/025 53/426 |
| 2019/0337664 | A1 * | 11/2019 | Dammers | B65D 5/0209 |
| 2020/0017248 | A1 | 1/2020 | Dahlmanns et al. | |

FOREIGN PATENT DOCUMENTS

| | | | |
|---|---|---|---|
| CN | 206766540 | U | 12/2017 |
| CN | 110114273 | A | 8/2019 |
| DE | 1191287 | B | 4/1965 |
| DE | 102014100203 | A1 | 7/2015 |
| DE | 102015110387 | A1 | 12/2016 |
| GB | 2483456 | A | 3/2012 |
| JP | S5274494 | A | 6/1977 |
| JP | S5274494 | U | 6/1977 |
| JP | H9254935 | A | 9/1997 |
| JP | 3077126 | U | 5/2001 |
| JP | 2006123937 | A | 5/2006 |
| JP | 2009233859 | A | 10/2009 |
| JP | 2015227172 | A | 12/2015 |
| JP | 2016500389 | A | 1/2016 |
| JP | 201756997 | A | 3/2017 |
| SE | 451322 | B | 9/1987 |
| WO | 2018114560 | A2 | 6/2018 |

* cited by examiner

BUNDLE COMPRISING PACKAGING SLEEVES AND AN OUTER PACKAGING

CROSS-REFERENCE TO RELATED APPLICATIONS

This application is the United States national phase of International Application No. PCT/EP2018/082922 filed Nov. 29, 2018, and claims priority to German Patent Application No. 10 2017 131 262.5 filed Dec. 22, 2017, the disclosures of which are hereby incorporated by reference in their entirety.

BACKGROUND OF THE INVENTION

Field of the Invention

The invention relates to a bundle comprising packaging sleeves and an outer packaging comprising: a plurality of packaging sleeves of a composite material, and an outer packaging which surrounds the packaging sleeves, wherein each packaging sleeve has a front side and a rear side, wherein the front side and the rear side of each packaging sleeve are separated from each other by means of folding edges, along which the packaging sleeve is folded flat, wherein each packaging sleeve has two openings which are arranged on opposite sides of the packaging sleeve, and wherein each packaging sleeve has a longitudinal seam which connects two edges of the composite material to form a circumferential packaging sleeve.

Description of the Related Art

Packagings can be produced in different manners and from extremely different materials. A widespread possibility for the production thereof involves producing a blank from the packaging material, from which by means of folding and additional steps first a packaging sleeve and finally a packaging is produced. This type of production has inter alia the advantage that the blanks and packaging sleeves are very flat and consequently can be stacked in a space-saving manner. In this manner, the blanks or packaging sleeves can be produced at a different location in relation to the folding and filling of the packaging sleeves. As a material, composite materials are often used, for example, a composition of a plurality of thin layers of paper, cardboard, plastics material or metal, in particular aluminium. Such packagings are widely used in particular in the food industry and are used there preferably for packaging foodstuffs which have at least one liquid component.

A first production step often involves producing a circumferential packaging sleeve from a blank by means of folding and welding or adhesively bonding a seam. The flat packaging sleeves are often stacked and packed in order to take them to the location for filling the packaging sleeves. From the prior art, bundles with different outer packagings are known for this purpose.

In a first known bundle (FIG. 2A), a rigid box of corrugated cardboard is used as an outer packaging. Such outer packagings provide good mechanical protection for the packaging sleeves which are stored therein. However, a disadvantage of such outer packagings is the very low resilience, which does not enable the bundle to be pressed together and consequently to be transported in a space-saving manner. In addition, a rigid outer packaging has the disadvantage after the removal of the packaging sleeves of having to be disassembled in order to take up less space. In addition, when rigid outer packagings of cardboard are disassembled, there is produced dust, which is very undesirable in regions with high hygienic requirements, for example, in the environment of a filling machine for foodstuffs.

In another known bundle (FIG. 2B), the outer packaging is in contrast formed from paper, the packaging sleeves are thus covered in paper. Such an outer packaging may therefore after the removal of the packaging sleeves be simply folded together and disposed of. A disadvantage of such an outer packaging is, however, the low resilience and low tear-resistance of the paper. The bundle therefore cannot take up therein any packaging sleeves which have been pressed together in a space-saving manner since the restoring forces would lead to the paper tearing.

In addition, with the known outer packagings of paper or corrugated cardboard, it is hardly possible to reduce the gas exchange between the volume enclosed in the outer packaging and the environment to a degree which is desirable or required from a microbiological viewpoint.

Against this background, an object of the invention is to configure and develop the bundle described in the introduction and explained in greater detail above whilst preventing the above-described disadvantages in such a manner that a space-saving, cost-effective and reliable transport of packaging sleeves is enabled.

SUMMARY OF THE INVENTION

This object is achieved with a bundle according to the invention in that the outer packaging is produced from a plastics material film.

A bundle according to the invention is formed from an assembly of packaging sleeves and an outer packaging. The bundle first comprises a plurality of packaging sleeves of a composite material. In particular, the packaging sleeves may comprise a combination of several thin layers of paper, card, plastics material or metal, in particular aluminium. Preferably, the packaging sleeves are in one piece. The bundle additionally comprises an outer packaging which surrounds the packaging sleeves. The outer packaging may partially or completely surround the packaging sleeves and serves to hold the packaging sleeves together. Each packaging sleeve has a front side and a rear side. Preferably, the front side and the rear side are rectangular and congruent. The front side and the rear side of each packaging sleeve are separated from each other by folding edges. Each packaging sleeve is folded flat along the folding edges. The folding edges may be produced, for example, by means of a fold along material weaknesses produced prior to the folding (for example, embossed crease lines). Each packaging sleeve additionally has two openings which are arranged at opposing sides of the packaging sleeve. That is to say, the packaging sleeve is open at two sides. The openings may, for example, be arranged in the region of a base face and in the region of a gable surface of the preferably fluid-tight packaging which is intended to be produced from the packaging sleeve. As a result of the two opposing openings, the packaging sleeve can be folded in a particularly simple manner, whereby the shape of a pipe or a sleeve is produced. Each packaging sleeve finally has a longitudinal seam which connects two edges of the composite material to form a circumferential packaging sleeve. As a result of the longitudinal seam, a circumferential packaging sleeve which is closed in a peripheral direction can be produced from a flat—mostly rectangular—blank.

The longitudinal seam may, for example, be produced by means of adhesive bonding and/or welding. As a result of the longitudinal seam, such packaging sleeves are also referred to as longitudinal seam sealed packaging sleeves.

According to the invention there is provision for the outer packaging to be produced from a plastics material film. Plastics material films are distinguished by low costs, a high resilience and a high tear-resistance. In contrast to rigid outer packagings (for example, boxes of corrugated cardboard), it is possible to compress the bundle and transport it in a space-saving manner. In contrast to less tear-resistant outer packagings (for example, of paper), it is possible to take up therein compressed packaging sleeves without the plastics material film tearing. The plastics material film may, for example, be produced from PE (polyethylene). Preferably, the plastics material film is antistatic since this is advantageous in the event of an expansion of the film and when stacking/unstacking several finished bundles. In addition, the plastics material film can preferably be printed or adhesively bonded. The plastics material film should additionally where possible be temperature-resistant.

According to an embodiment of the bundle, there is provision for the outer packaging to assemble the packaging sleeves in such a manner that in the stacking direction at least 4.0 packaging sleeves per cm, in particular at least 4.5 packaging sleeves per cm, in particular at least 5.0 packaging sleeves per cm, in particular at least 5.5 packaging sleeves per cm, in particular at least 6.0 packaging sleeves per cm, in particular at least 6.5 packaging sleeves per cm, in particular at least 6.75 packaging sleeves per cm, in particular at least 7.0 packaging sleeves per cm, in particular at least 7.25 packaging sleeves per cm or at least 7.5 packaging sleeves per cm are arranged. The stacking direction is intended to be understood to be the direction which extends through all the stacked packaging sleeves; the stacking direction may in particular extend substantially at right-angles to the front sides and rear sides of the packaging sleeves. As a result of the resilience and high tear-resistance of the plastics material film, a high stacking density can be achieved. This may, for example, be achieved by the packaging sleeves being pushed together and compressed in the stacking direction and in this state being wrapped by a pretensioned film. As a result of the pretensioning of the film, the film pulls itself together after the packaging sleeves have been wrapped and thus prevents the packaging sleeves from being pressed out of the still open ends of the film again by restoring forces. The lower limits set out for the stacking density can be combined with an upper limit for the stacking density, which may be, for example, 8 packaging sleeves per cm, 9 packaging sleeves per cm or 10 packaging sleeves per cm. Higher stacking densities may lead to damage to the packaging sleeves.

According to another embodiment of the bundle, there is provision for the packaging sleeves to be arranged in the outer packaging in such a manner that the longitudinal seams of all the packaging sleeves extend parallel with each other. That is to say, all the packaging sleeves are supposed to stand "upright" in the outer packaging and no packaging sleeve is supposed to lie transversely in the outer packaging (or vice versa: all are intended to be located "transversely" and none stand "upright"). Although the defined and identical arrangement of the packaging sleeves in the bundle is potentially not the most space-saving arrangement, it does facilitate the further processing of the packaging sleeves in a filling machine considerably since a sorting or orientation can be dispensed with.

According to another embodiment of the bundle, there is provision for the packaging sleeves to be arranged in the outer packaging in such a manner that the longitudinal seams of all the packaging sleeves are arranged in a common plane which extends in the stacking direction. That is to say, the longitudinal seams should not be arranged offset from each other in different planes, but instead in the same plane. They should thus—when viewed in the stacking direction—be arranged precisely one behind the other. This decreases as a result of the increased thickness in the region of the longitudinal seam to a reduced stacking density, but it facilitates the further processing of the packaging sleeves in a filling machine considerably since all the packaging sleeves can be introduced one after the other into the filling machine in an identical position.

A stack arranged precisely one behind the other may be understood to be lateral offsets of up to 1.5 mm in both directions.

According to another embodiment of the bundle, there is provision for the packaging sleeves to be arranged in the outer packaging in such a manner that the front sides of all the packaging sleeves face in the same direction and for the rear sides of all the packaging sleeves to face in the same direction. That is to say, two adjacent packaging sleeves are always intended to touch each other with different sides (front side/rear side) and not with the same sides (front side/front side or rear side/rear side). This type of defined and ordered orientation of the packaging sleeves also facilitates the further processing in a filling machine since the packaging sleeve stack can be placed in the magazine of the filling machine without the need for sorting or orientation.

According to an embodiment of the bundle, there is provision for the packaging sleeves to be folded flat along both folding edges through an angle of approximately 180°. The folding through an angle of approximately 180° enables particularly flat packaging sleeves. This enables space-saving stacking of packaging sleeves, which, for example, facilitates the transport. In this manner, the packaging sleeves may be produced at a different location in relation to the filling and production of the packagings. Preferably, the packaging sleeve is folded outwards along both folding edges, the folding edges should therefore face outwards (and not inwards). The packaging sleeves can thereby be stacked particularly close to each other.

According to another embodiment of the bundle, there is provision for the two folding edges to extend parallel with each other. Preferably, both folding edges are linear and extend parallel with each other. The parallel arrangement has the advantage that the folding edges can be produced in a particularly simple manner, for example, by means of linear crease lines which are embossed in the composite material.

Another embodiment of the bundle makes provision for the packaging sleeves to be folded exclusively along the two folding edges. With no other folding of the packaging sleeves being provided other than the two folding edges, the packaging sleeves are particularly flat and can be stacked in a space-saving manner. With the exception of the region of the longitudinal seam, the packaging sleeves have in this type of folding a "dual" thickness: both the front side and the rear side of the packaging sleeve are formed by a (preferably the same) multi-layer composite material and arranged one behind the other in a stacking direction.

According to another embodiment of the bundle, there is provision for the packaging sleeves to have base faces and gable faces which are arranged at opposite sides of the two side faces, the front face and the rear face. Preferably, the base faces and the gable faces each have two rectangular faces and six triangular faces. Preferably, the gable faces—in an upright packaging—are arranged above the two side faces, the front face and the rear face and the base faces are arranged below the two side faces, the front face and the rear face. The designation of the faces is based on the faces of the packaging which is intended to be produced from the packaging sleeve. Preferably, the rectangular faces and the triangular faces are also surrounded or bordered by folding lines. The rectangular faces serve to fold the base and the gable of the packaging. The triangular faces serve to fold the excess composite material into protruding "lugs" which are subsequently placed on the packaging.

According to another embodiment of the bundle, there is provision for the composite material of the packaging sleeves to have a strength in the range between 150 g/m$^2$ and 500 g/m$^2$, in particular between 200 g/m$^2$ and 350 g/m$^2$. The strength of the composite material has an influence on the thickness thereof and consequently also on the number of packaging sleeves which can be stacked per length unit. A strength in the given range has been found to be a good compromise between low costs, low weight and dense stackability (thinnest possible composite material) and adequate mechanical properties (thickest possible composite material).

In another embodiment of the bundle, there is provision for the composite material of the packaging sleeves to have a thickness in the range between 0.25 mm and 0.75 mm, in particular between 0.3 mm and 0.6 mm. A thickness in the range set out has been found to be a good compromise between low costs, low weight and dense stackability (composite material as thin as possible) and adequate mechanical properties (composite material as thick as possible).

According to another embodiment of the bundle, there is provision for the composite material to have at least one layer of paper, card or cardboard which is covered at the edge of the longitudinal seam extending inside the packaging sleeve. The cover of the paper layer, card layer or cardboard layer is intended to prevent any contact between the content of the packaging and this layer. This serves, on the one hand, to prevent discharge of fluid through the—non-fluid-tight—paper layer, card layer or cardboard layer and, on the other hand, to protect the content of the packaging from contamination as a result of the paper layer, card layer or cardboard layer (for example, fibres of the pulp).

The covering of the longitudinal seam may advantageously be carried out by the layer of paper, card or cardboard being covered by a sealing strip and/or by placing the composite material in the region of the longitudinal seam. One possibility for covering is securing a separate sealing strip. The sealing strip may, for example, be produced from the same material as the innermost layer of the composite material and be adhesively bonded or welded to this layer. Another possibility for covering involves the composite material being turned or folded over in the region of the longitudinal seam. In this manner, at the edge of the longitudinal seam extending inside the packaging sleeve no longer all the layers but instead only the innermost layer of the composite material still appears. However, the innermost layer must in any case be produced from a material which is suitable for contact with the content of the packaging.

According to another embodiment of the bundle, there is provision for the composite material to be peeled in the region of the longitudinal seam. A "peeled" composite material is intended to be understood to be a composite material which has fewer layers in the peeled region than in the remaining regions. The peeling has in particular in the region of overlaps of a plurality of material layers the advantage of a less significant increase in thickness. It is therefore particularly advantageous to use peeled composite material when the composite material is turned or folded over—for example, in the region of the longitudinal seam.

Another embodiment of the bundle is characterised by a material weakening in the packaging sleeves, in particular in an overcoated hole, for securing a pouring element. The material weakening serves to facilitate the subsequent fitting of a pouring element to the respective packaging sleeve. To this end, for example, a through-hole is initially punched in the composite material and is subsequently overcoated. The overcoating may, for example, be carried out with a plastics material film and serves to seal the packaging until the pouring element is applied.

According to another embodiment of the bundle, there is provision for the plastics material film to have a thickness in the range between 10 μm and 50 μm, in particular between 15 μm and 40 μm. Very thin films have the advantage of low costs and low weight, whilst thicker films have a greater tear resistance. Films with a thickness in the range set out have been found to be a good compromise between these requirements. The thickness of the film may, for example, be measured in accordance with DIN 53370.

In another embodiment of the bundle, there is provision for the plastics material film to be multi-layered. The different layers of the film may be produced from the same material or from different materials, for example, from PE (polyethylene) and/or PP (polypropylene) and/or PA (polyamide). In addition, the different layers of the film may have the same thickness or different thicknesses. By using films of different materials and different thicknesses, the desired properties of the film can be combined and adjusted in an optimum manner.

According to another embodiment of the bundle, there is provision for the plastics material film to have stretch properties and/or shrinking properties. A stretch film (also called "expansion film") is intended to be understood to be a film which has a very high capacity for expansion, in particular an elongation at break of at least 100%, in particular at least 150%, at least 200% or at least 300% (for example, measured in accordance with DIN EN ISO 527). A high expandability particularly has the advantage that the film even with a high loading does not tear. A shrink film is intended to be understood to be a film which under specific conditions—in particular when heated and subsequently cooled—contracts and consequently "shrinks". Preferably, the film has a shrink value of at least 5%, in particular at least 10%, at least 20%, at least 30% or at least 40%. Films with shrink properties have the advantage that the film is applied true-to-contour around the contents which are intended to be packaged and they can where applicable even be compressed.

There may be provision for the stretch properties and/or the shrink properties of the film to be direction-dependent. In particular, there may be provision for the stretch properties and/or the shrink properties of the film in the longitudinal direction and in the transverse direction to be different, wherein the longitudinal direction and the transverse direction define an angle of 90°. There may be provision for the elongation at break in the transverse direction to be at least 50% higher, in particular at least 75%, at least 100% or at least 200% higher than in the longitudinal direction (or vice versa). Alternatively or additionally, there may be provision for the shrink value in the longitudinal direction to be at least 100% higher, in particular at least 150%, at least 200% or at least 300% higher than in a transverse direction (or vice versa). In this manner, an optimum adjustment of the mechanical properties of the film with regard to the packaging sleeves which are intended to be packed can be achieved. Preferably, the shrink value of the film in a stacking direction is greater than in the other two spatial directions so that the bundle when the film shrinks is compressed particularly in the stacking direction. Alternatively, it may be desirable for the shrink value of the film to be greater in the peripheral direction of the bundle than in the two spatial directions so that the film during shrinking is placed in an undulating manner in the intermediate spaces between adjacent packaging sleeves.

According to another embodiment of the bundle, there is provision for the plastics material film to surround the packaging sleeves in an undulating manner at least in the region of the folding edges. The undulating shape can be achieved, for example, by means of a shrink film which contracts and which in this instance is pulled into the intermediate spaces between adjacent packaging sleeves. As a result of the undulating shape, the packaging sleeves are secured against sliding.

According to another embodiment of the bundle, there is provision for the plastics material film to have at least one weld seam which preferably extends substantially in a stacking direction. This enables the outer packaging to be produced from a single film piece which is wound around the packaging sleeve assembly and is welded. Alternatively, there may be provision for the plastics material film to have two weld seams which preferably extend substantially in a stacking direction. This enables the outer packaging to be produced from two film pieces which are placed at both sides around the packaging sleeve assembly and welded.

Alternatively, there may be provision for the film to already be produced in a tubular manner (for example, by means of extrusion). This enables no weld seam at all to be provided in the stacking direction. The packaging sleeve assembly may instead be pushed into the tubular or cylindrical film.

In another embodiment of the bundle, there is provision for the plastics material film to have at least one welded end which is preferably arranged at one of the end sides of the bundle. The width of the film is preferably greater than the length of the packaging sleeve assembly which is intended to be packaged. There are therefore formed at both end sides of the packaging sleeve assembly openings which are intended to be closed. One possibility in this regard involves the overhanging ends of the plastics material film being welded together. Depending on the length of the overhanging ends, completely welded ends are formed or there remains after the welding on the end side an opening which can also be referred to as a "window".

According to another embodiment of the bundle, there is finally provision for the plastics material film to comprise a printing. The printing may be a machine-readable code, for example a barcode or a two-dimensional code (2d-code), in particular a QR-code. The printing may for example contain information on the product, the production or the product tracking. Alternatively or additionally, the printing may contain information on the positioning and/or the gripping and/or the opening of the bundle which facilitates further processing of the bundle in a filling machine. There may be provision for the printing to be printed directly onto the plastics material film or onto a label that sticks on the plastics material film.

BRIEF DESCRIPTION OF THE DRAWING

The invention is explained in greater detail below with reference to just one preferred embodiment. In the drawings.

DESCRIPTION OF THE INVENTION

Figure 1A:
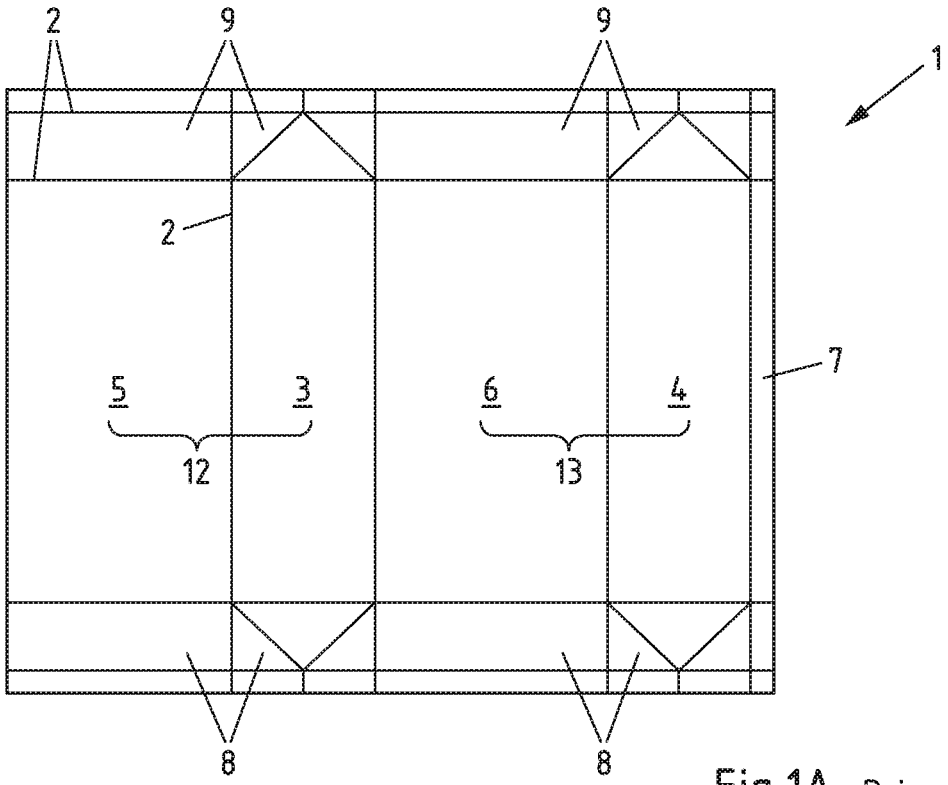
Fig.1A Prior Art
FIG. 1A shows a blank known from the prior art for folding a packaging sleeve.

FIG. 1A shows a blank 1 which is known from the prior art and from which a packaging sleeve can be formed. The blank 1 may comprise several layers of different materials, for example, paper, card, cardboard, plastics material or metal, in particular aluminium. The blank 1 has a plurality of folding lines 2 which are intended to facilitate the folding of the blank 1 and which divide the blank 1 into a plurality of faces. The blank 1 may be subdivided into a first side face 3, a second side face 4, a front face 5, a rear face 6, a sealing face 7, base faces 8 and gable faces 9. From the blank 1, a packaging sleeve can be formed by the blank 1 being folded in such a manner that the sealing face 7 can be connected to the front face 5, in particular welded.

Figure 1B:
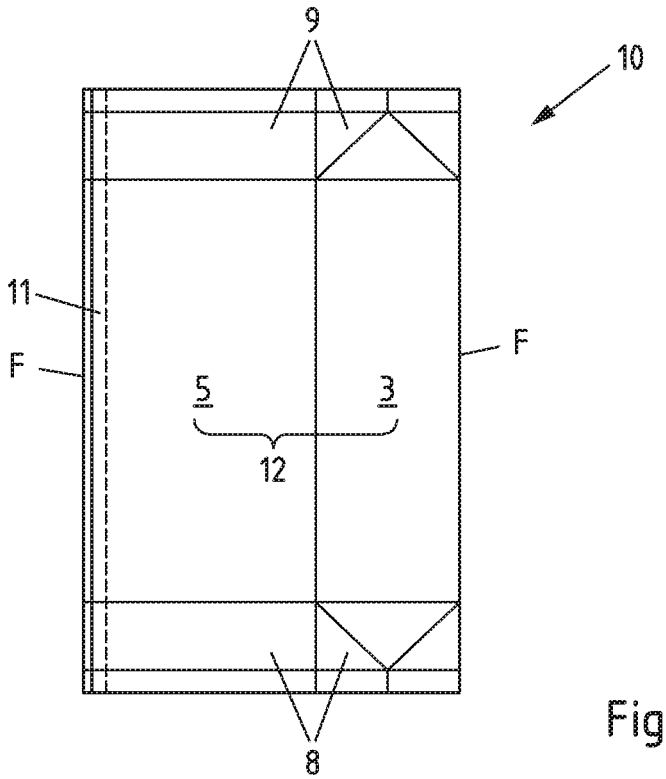
Fig.1B Prior Art
FIG. 1B: shows a packaging sleeve which is known from the prior art and which is formed from the blank shown in FIG. 1A, in the folded-flat state.

FIG. 1B shows a packaging sleeve 10 known from the prior art in the folded-flat state. The regions of the packaging sleeve already described in relation to FIG. 1A are provided in FIG. 1B with corresponding reference numerals. The packaging sleeve 10 is formed from the blank 1 shown in FIG. 1A. To this end, the blank 1 was folded in such a manner that the sealing face 7 and the front faces are arranged so as to overlap so that the two faces can be welded to each other in a flat manner. As a result, a longitudinal seam 11 is produced. In FIG. 1B, the packaging sleeve 10 is illustrated in a state folded together in a flat manner along two folding edges F. In this state, a side face 4 (concealed in FIG. 1B) is located below the front face 5, whilst the other side face 3 is located on the rear face 6 (concealed in FIG. 1B). The front face 5 and the adjacent side face 3 consequently form a front side 12 of the packaging sleeve 10 and the rear face 6 and the adjacent side face 6 consequently form a rear side 13 of the packaging sleeve 10. In the state folded together flat, a plurality of packaging sleeves 10 can be stacked in a particularly space-saving manner. Therefore, the packaging sleeves 10 are frequently stacked at the location of production and transported in stacks to the filling location. The packaging sleeves 10 are unstacked only at that location and unfolded in order to be able to be filled with contents, for example, with foodstuffs. The filling can be carried out under aseptic conditions. The foodstuffs may contain at least one liquid component.

Figure 2A:
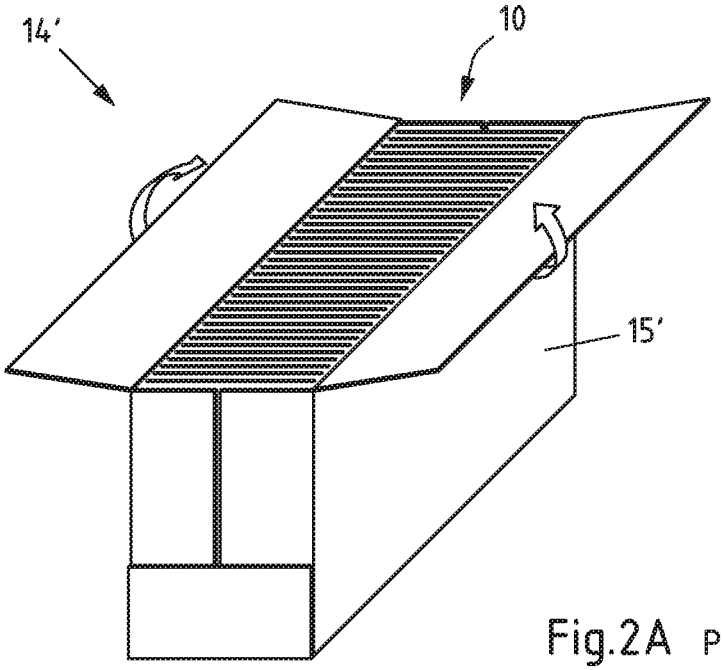
Fig.2A Prior Art
FIG. 2A: shows a first bundle known from the prior art comprising an outer packaging and a plurality of packaging sleeves.
Figure 2B:
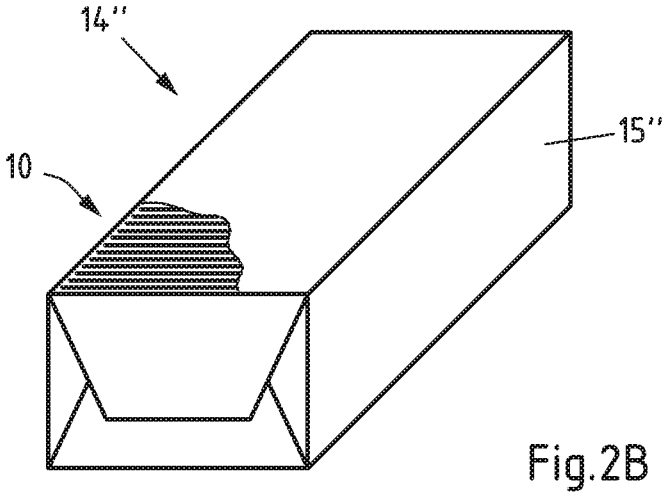
Fig.2B Prior Art
FIG. 2B: shows a second bundle known from the prior art comprising an outer packaging and a plurality of packaging sleeves.

FIG. 2A shows a first bundle 14' known from the prior art comprising an outer packaging 15' and a plurality of packaging sleeves 10 and FIG. 2B shows a second bundle 14" known from the prior art comprising an outer packaging 15" and a plurality of packaging sleeves 10. In the bundle 14' shown in FIG. 2A, the outer packaging 15' is formed from corrugated cardboard and is consequently very rigid. The outer packaging 15' from FIG. 2A therefore provides very good mechanical protection for the packaging sleeves 10 stored therein. A disadvantage of the outer packaging 15' involves, however, the very low level of resilience which does not enable the bundle 14' to be compressed and consequently transported in a space-saving manner. In addition, a rigid outer packaging has the disadvantage of having to be disassembled after the removal of the packaging sleeves 10 in order to take up less space. In the bundle 14" shown in FIG. 2B, the outer packaging 15" is formed from paper, the packaging sleeves 10 are thus enclosed like a present in paper. The outer packaging 15" can therefore be simply folded together after the removal of the packaging sleeves 10 and disposed of. However, a disadvantage of the outer packaging 15" is the low level of resilience and low tear resistance of the paper. The bundle 14" therefore cannot take up therein any packaging sleeves 10 which have been compressed in a space-saving manner since the restoring forces would lead to the paper tearing.

Figure 3B:
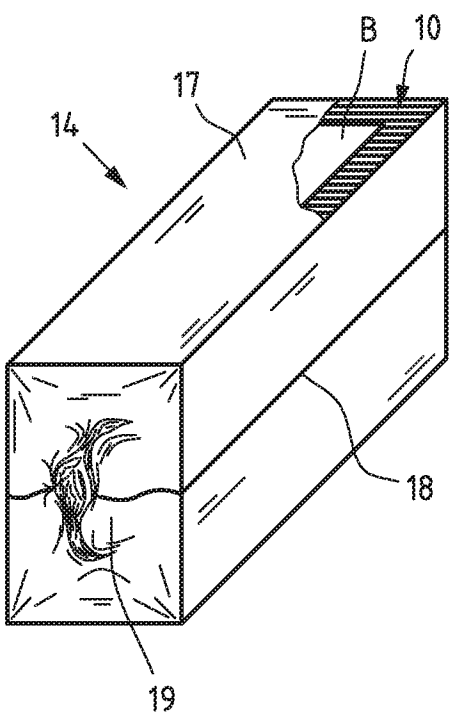
FIG. 3B: shows a first embodiment of a bundle according to the invention.
Figure 3A:
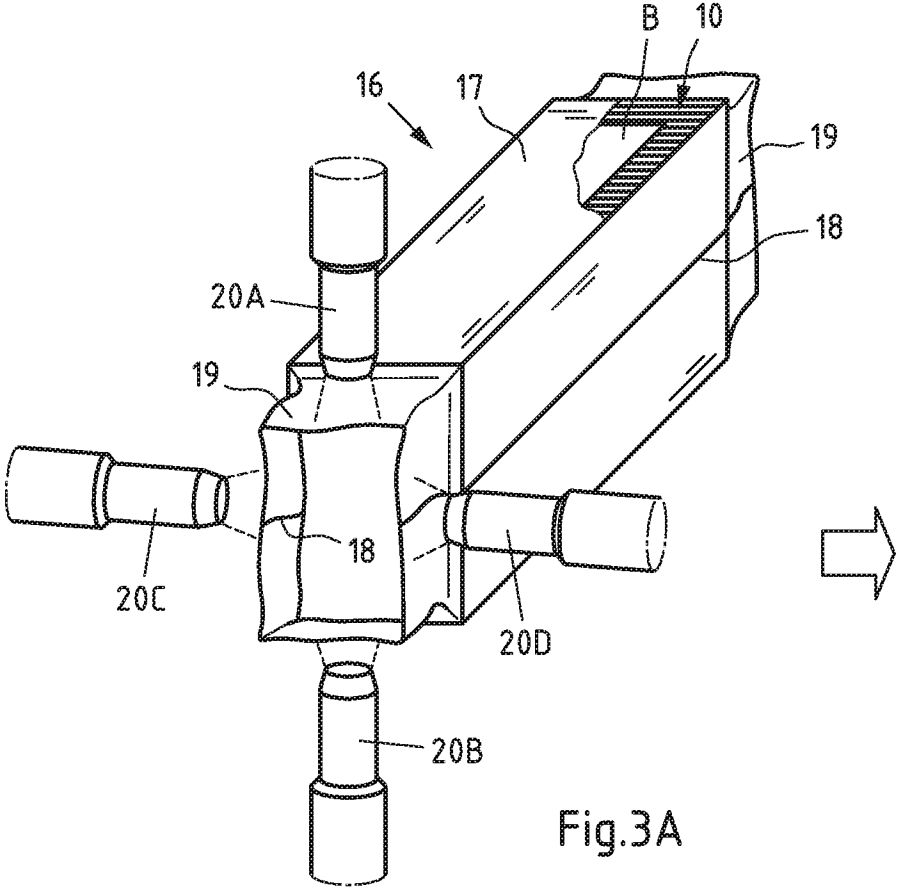
FIG. 3A: shows a first embodiment of a packaging sleeve assembly having an outer packaging.

FIG. 3A shows a first embodiment of a packaging sleeve assembly 16 having an outer packaging and FIG. 3B shows a first embodiment of a bundle 14 according to the invention which has been produced from it. For better understanding, FIG. 3A and FIG. 3B are perspective illustrations. Those regions which have already been described above are provided in FIG. 3A and FIG. 3B with corresponding reference numerals. In FIG. 3A and in FIG. 3B, the outer packaging 15 is formed from a resilient plastics material film 17. The plastics material film may have a weld seam 18 or also a plurality of weld seams 18, for example, two weld seams 18 which are arranged at opposing sides. The protruding ends 19 of the plastics material film 17 may be redirected at both end sides of the packaging sleeve assembly 16 by means of hot air. To this end, at both end sides of the packaging sleeve assembly 16, there are preferably arranged four hot air nozzles 20A, 20B, 20C and 20D of which only the front nozzles are shown. The action on the protruding ends 19 of the plastics material film 17 leads to them resting on the end faces of the packaging sleeve assembly 16 and being able to be welded to each other at that location, as can be seen in FIG. 3B, where a completed bundle 14 with closed ends 19 is illustrated. As a result of the relatively large quantity of material of the welded ends of the plastics material film 17, it has in the central region of the end sides an irregularly formed structure, which, however, is harmless for the function of the outer packaging. It can additionally be seen that, at both sides of the bundle 14, weld seams 18 are placed around the end sides. Preferably, hot air is first supplied to the opposing nozzles 20A and 20B so that the protruding upper and lower ends 19 of the plastics material film 17 are applied to the end side of the packaging sleeve assembly 16 before the nozzles 20C and 20D are then activated so that all the protruding ends 19 are applied in a flat manner and are welded to each other. It is clear that in this instance no welding between the plastics material film 17 and the coating of the outer packaging sleeves 10 of the packaging sleeve assembly 16 is intended to be carried out. Finally, it can be seen clearly in FIG. 3A that the packaging sleeve assembly 16 in the region of the end sides thereof both at the corners and along the edges thereof surround the packaging sleeve assembly 16 in a tight manner, whereby a solid unit, which is inherently stable and consequently easy to transport, is produced. In FIG. 3A and in FIG. 3B—and in some following figures—there is additionally illustrated a loading carrier B which—in the same manner as the packaging sleeves 10—is surrounded by the plastics material film 17. The loading carrier B may, for example, be placed on the packaging sleeves 10 and consequently be arranged between the packaging sleeves 10 and the plastics material film 17. The loading carrier B is intended to receive active substances and introduce them into the bundle 14, for example, a sterilisation agent. The loading carrier B may, for example, be constructed as a flat sheet. The loading carrier B is only optional; therefore, a bundle 14 according to the invention may or may not have a loading carrier B.

Figure 4B:
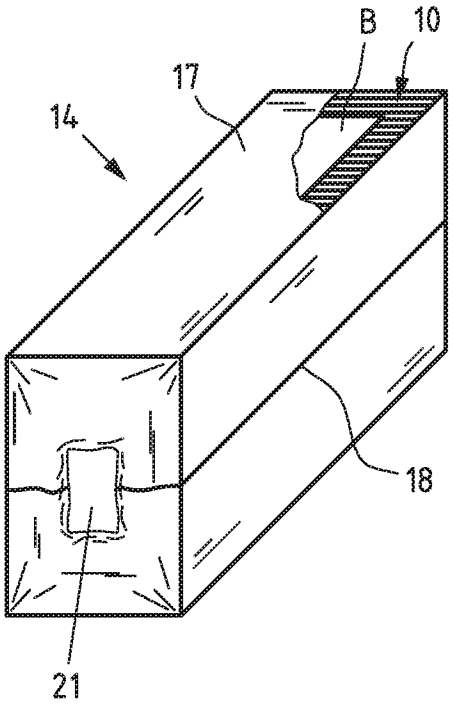
FIG. 4B: shows a second embodiment of a bundle according to the invention.
Figure 4A:
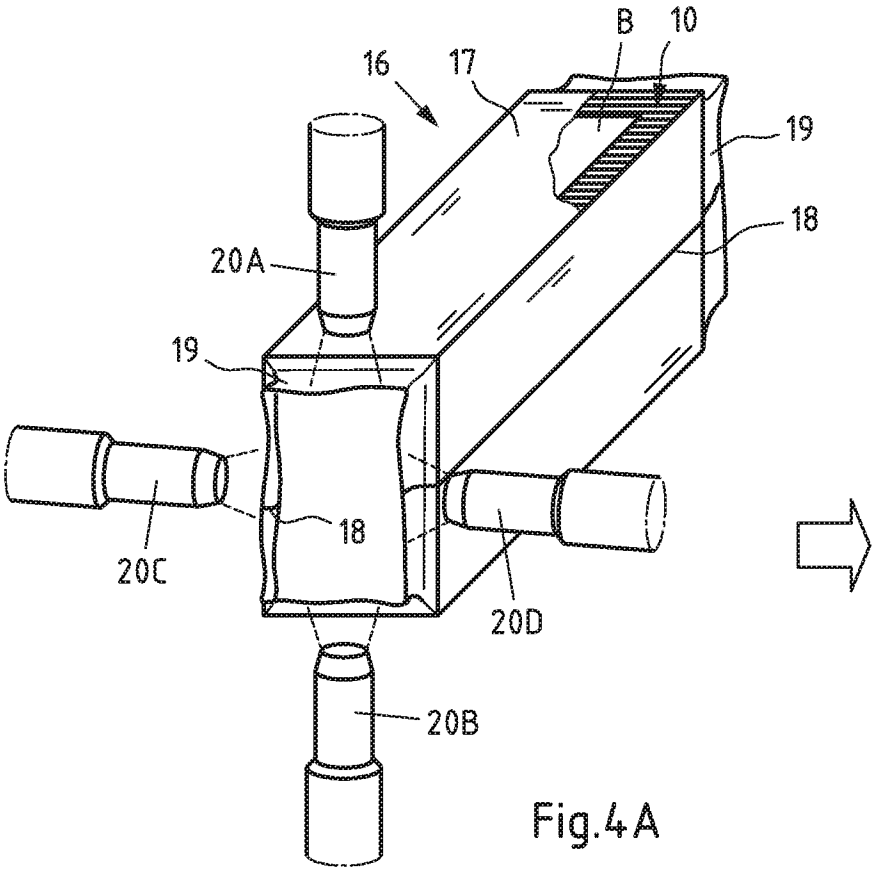
FIG. 4A: shows a second embodiment of a packaging sleeve assembly having an outer packaging.

FIG. 4A shows a second embodiment of a packaging sleeve assembly 16 with an outer packaging and FIG. 4B shows a second embodiment of a bundle 14 according to the invention which has been produced therefrom. For better understanding, FIG. 4A and FIG. 4B are perspective illustrations. Those regions which have already been described above are also provided with corresponding reference numerals in FIG. 4A and in FIG. 4B. The difference from FIG. 3A and FIG. 3B is that the width of the plastics material film 17 with respect to the length of the packaging sleeve assembly 16 is shorter so that the protruding ends 19 are shorter. This leads to the end sides of the packaging sleeve assembly 16 not being able to be fully covered with plastics material film when the protruding ends 19 are turned over on the end face and welded to each other. In FIG. 4B, it can instead be seen that a type of window 21 is formed in the centre of the end faces. Such an embodiment of a completed bundle 14 is, for example, desirable when on the end sides no thickening is intended to be carried out by means of plastics material film 17 which is welded together.

Figure 5B:
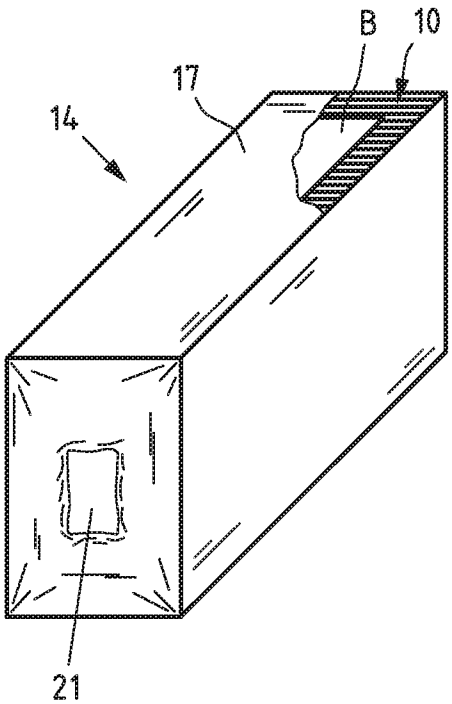
FIG. 5B: shows a third embodiment of a bundle according to the invention.
Figure 5A:
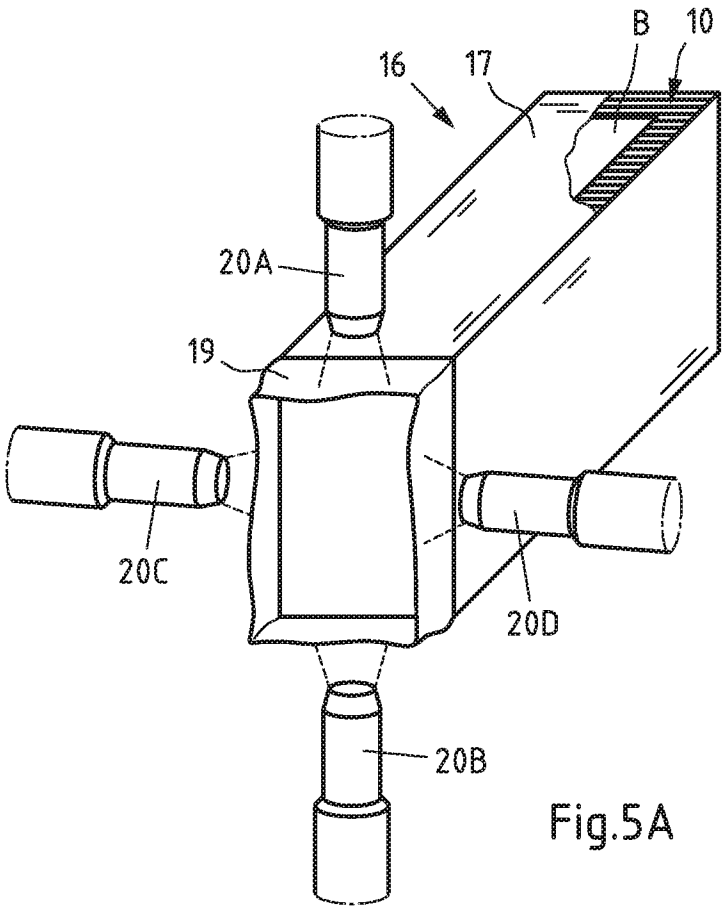
FIG. 5A: shows a third embodiment of a packaging sleeve assembly having an outer packaging.

FIG. 5A shows a second embodiment of a packaging sleeve assembly 16 having an outer packaging and FIG. 5B shows a second embodiment of a bundle 14 according to the invention which is produced therefrom. For better understanding, FIG. 5A and FIG. 5B are also perspective illustrations. Those regions which have already been described above are also provided in FIG. 5A and in FIG. 5B with corresponding reference numerals. The difference from FIG. 3A, FIG. 3B and FIG. 4A, FIG. 4B is that the plastics material film 17 has no weld seams. It is, for example, possible to dispense with the lateral weld seams which extend in the stacking direction by the plastics material film 17 already being produced in a tubular manner (for example, by means of extrusion). In addition, there may be provision for the plastics material film 17 to be in the form of a bag so that it is already closed at one end thereof (illustrated at the back in FIG. 5A and FIG. 5B) and only needs to be closed at the front end side.

Figure 6:
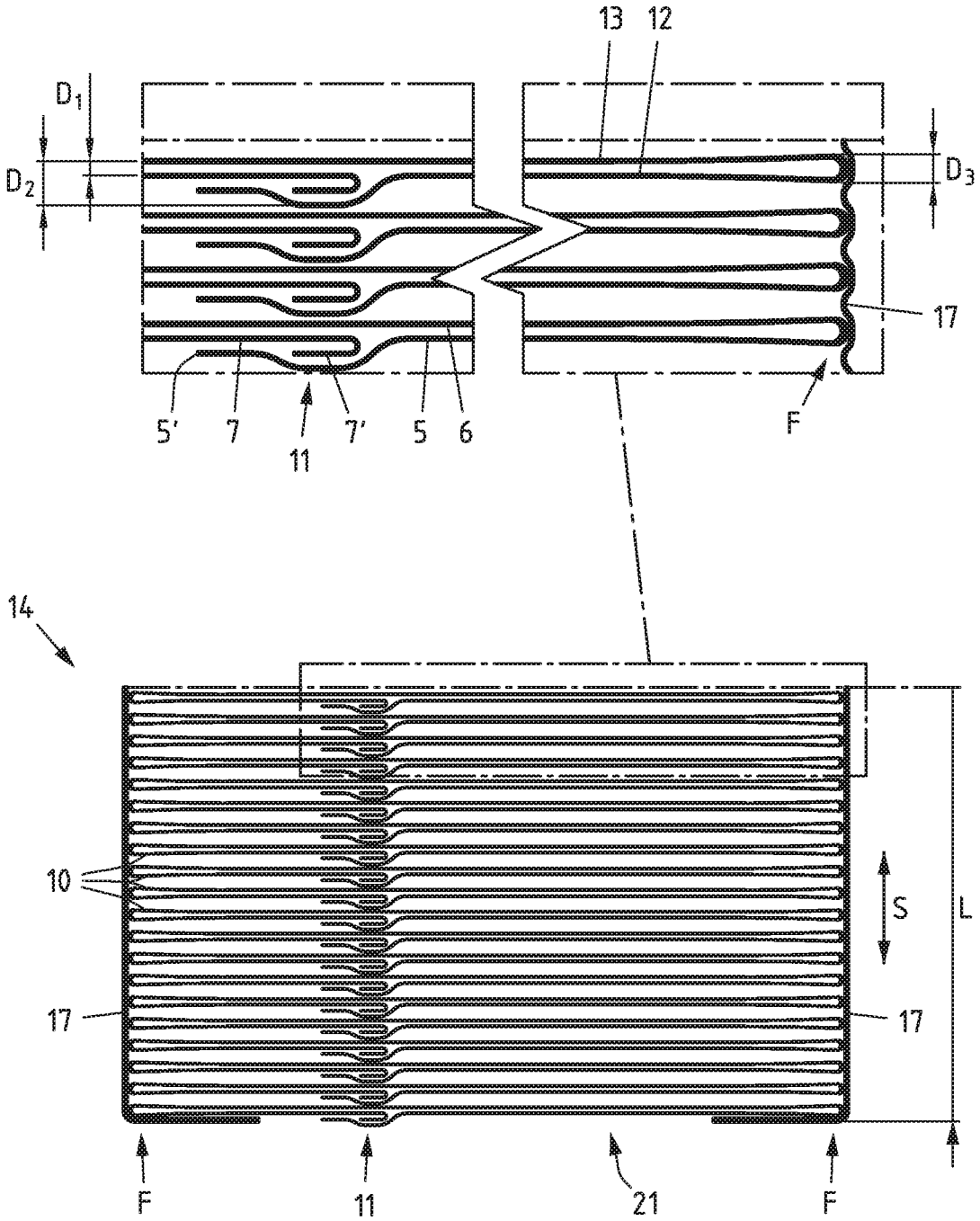
FIG. 6: is a plan view of a bundle according to the invention comprising an outer packaging and a plurality of packaging sleeves.

FIG. 6 is a plan view of a bundle 14 according to the invention comprising an outer packaging and a plurality of packaging sleeves 10. These regions which have already been described above are also provided in FIG. 6 with corresponding reference numerals. Twenty packaging sleeves 10 are shown which in a tightly stacked state are surrounded by a plastics material film 17 and held together. The stacking direction S is schematically illustrated by a double-headed arrow and extends perpendicularly through the packaging sleeves 10. The plastics material film 17 forms in the region of the lower end face a window 21, as already described in connection with FIG. 4B. It can be seen that each packaging sleeve 10 has three regions with increased thickness: the regions of the two folding edges F and the region of the longitudinal seam 11. This is particularly clear in the enlarged cut-out of FIG. 6 (illustrated at the top). The packaging sleeves 10 have a minimum thickness $D_1$, which is less than the thickness $D_2$ in the region of the longitudinal seam 11 and which is also smaller than the thickness $D_3$ in the region of the folding edges F. The increased thickness $D_2$ in the region of the longitudinal seam 11 results from the fact that the end region 5' of the front face 5 and the end region 7' of the sealing face 7 in the region of the longitudinal seam 11 form an overlap. In the region of the longitudinal seam 11, the packaging sleeve 10 thus has an at least triple-layered structure in place of a dual-layered structure. The thickness $D_1$ of the packaging sleeve 10 is, for example, in the range between 0.5 mm and 1.5 mm, whilst the increased thickness $D_2$ of the packaging sleeve 10 is, for example, in the range between 0.6 mm and 3.0 mm. The transition between the different thicknesses is also referred to as a "layer jump". The plastics material film 17 may lie in the region of the folding edges F around the packaging sleeves 10 and may therefore in this region be formed in an undulating manner (can be seen in the enlarged region of FIG. 5). This can be achieved by the resilience of the plastics material film 17 and/or by the use of a shrink film.

In addition to the overlap, one or both end regions 5', 7' may be folded over. A folding-over of the inner end region (in FIG. 6: end region 7') has the advantage that only the innermost layer of the material of the packaging sleeve 10 can come into contact with the content of the packaging which is intended to be produced therefrom. This results in other layers of the material of the packaging sleeve 10, for example, a central layer of paper, card or cardboard, being separated from the content of the packaging. In this manner, both the sealing of the packaging and hygienic requirements are ensured. A complete folding-over of the inner end region 7' would, however, lead to a further increase of the thickness of the packaging sleeve 10 in the region of the longitudinal seam 11. There may therefore be provision for only a few layers of the end region 7', in particular the innermost layer of the end region 7', to be folded over. To this end, the remaining layers are separated or peeled off before the folding-over action.

As can be seen in FIG. 6, the packaging sleeves 10 may be stacked only as closely as their thickest regions permit. These are in particular the regions of the two folding edges F and the region of the longitudinal seam 11. The density of the stacking of the packaging sleeves 10 can be measured and set out by the number of packaging sleeves 10 per length unit L being set out, wherein the length unit L is measured in the stacking direction S. In order to obtain the most precise possible indication of the stack density, a large number of packaging sleeves 10 should be counted and the number thereof be divided by the length unit L (for example, one hundred packaging sleeves 10). Preferably, the stacking density is at least 4.0 packaging sleeves per cm, in particular at least 4.5 packaging sleeves per cm, in particular at least 5.0 packaging sleeves per cm, in particular at least 5.5 packaging sleeves per cm, in particular at least 6.0 packaging sleeves per cm, in particular at least 6.5 packaging sleeves per cm, in particular at least 6.75 packaging sleeves per cm, in particular at least 7.0 packaging sleeves per cm, in particular at least 7.25 packaging sleeves per cm, or at least 7.5 packaging sleeves per cm.

Figure 7:
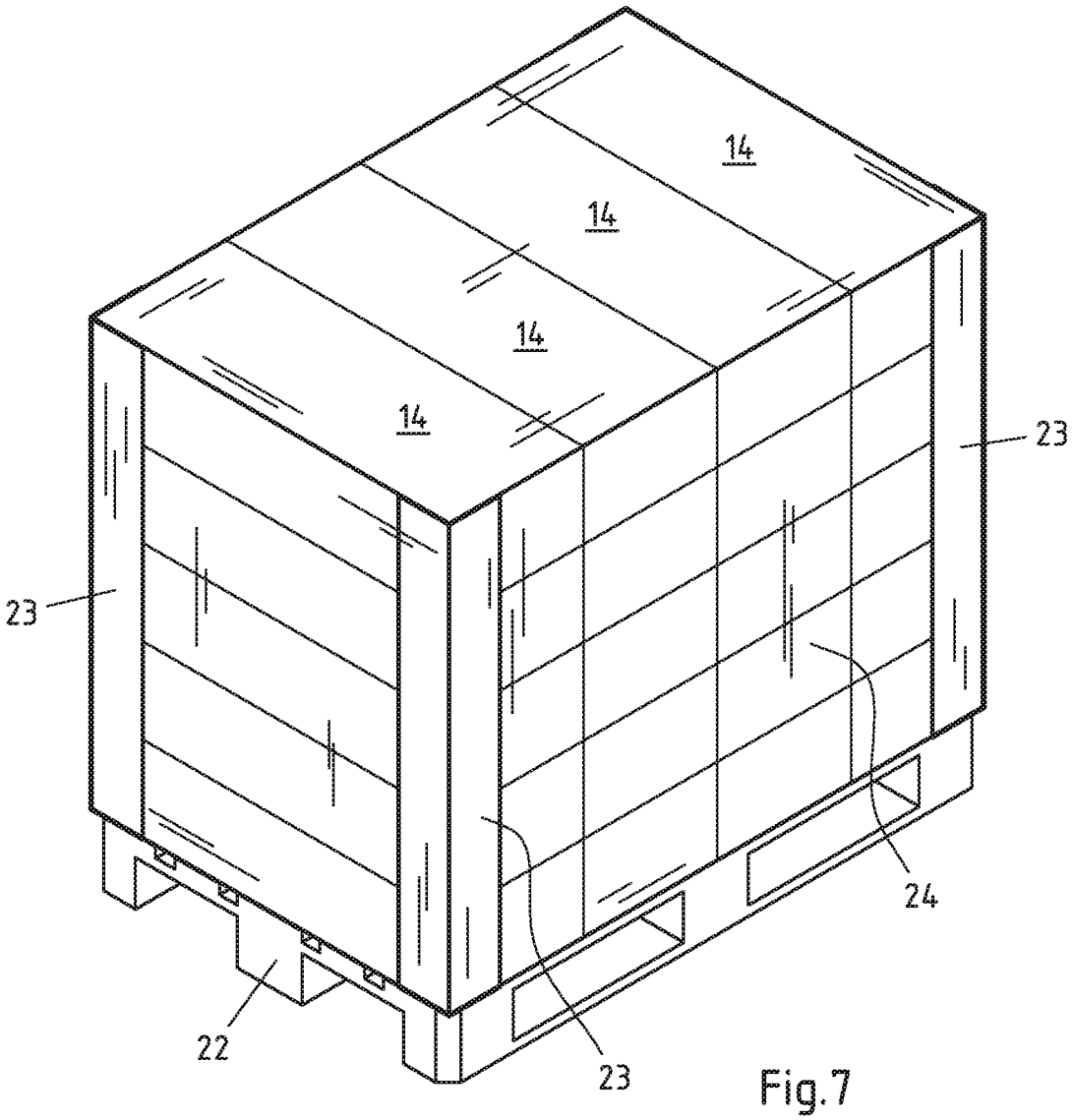
FIG. 7: shows a plurality of bundles according to the invention which are stacked on a pallet.

FIG. 7 finally shows a conventional pallet 22 which is known per se from the prior art and which is loaded with a large number of bundles 14 according to the invention. To this end, the individual bundles 14 which are formed from a packaging sleeve assembly 16 which has a large number of packaging sleeves 10 and an outer packaging which is formed from a plastics material film 17 are stacked on the pallet 22. Such pallets 22 which are loaded with the bundles 14 according to the invention are provided for the further transport of the packaging sleeves 10, for example, to the location of filling and production of the finished packagings.

FIG. 7 further shows that the edges of the bundles 14 which are stacked on the pallet 22 are provided with an edge protection 23 which is placed only for transport, for example, of reinforced cardboard. The assembly comprising bundles 14, edge protection 23 and at least the carrier side of the pallet 22 is then surrounded with a plastics material film 24, in particular a shrink film and/or stretch film and where applicable acted on with heat so that it forms a fixed unit which cannot slide when transported by lorry.

A system which is illustrated in FIG. 7 by way of example has various advantages compared with the systems known from the prior art, for example, the packaging units comprising packaging sleeves which are packed in a surrounding box as an outer packaging. In this instance, the significantly more cost-effective outer packaging of plastics material film should first be mentioned. Furthermore, the weight in contrast to the solutions in the prior art can be reduced. Furthermore, the waste caused by the outer packaging can be reduced and also a packaging unit which is better protected from contamination—for example, in the form of surrounding casing dust—can be achieved.

LIST OF REFERENCE NUMERALS

1: Blank
2: Folding line
3, 4: Side face
5: Front face
5': End region (of the front face 5)
6: Rear face
7: Sealing face
7': End region (of the sealing face 7)
8: Base face
9: Gable face
10: Packaging sleeve
11: Longitudinal seam
12: Front side (of the packaging sleeve 10)
13: Rear side (of the packaging sleeve 10)
14, 14', 14": Bundle
15, 15', 15": Outer packaging
16: Packaging sleeve assembly
17: Plastics material film
18: Weld seam
19: End (of the plastics material film 16)
20A, 20B, 20C, 20D: Hot air nozzle
21: Window
22: Pallet
23: Edge protection
B: Loading carrier
$D_1$: Minimum thickness (of the packaging sleeve 10)
$D_2$: Thickness (in the region of the longitudinal seam 11)
$D_3$: Thickness (in the region of the folding edges F)
L: Length unit
F: Folding edge (of the packaging sleeve 10)
S: Stacking direction

The invention claimed is:

1. A bundle comprising packaging sleeves and an outer packaging, comprising:

a plurality of packaging sleeves of a composite material, and an outer packaging which surrounds the packaging sleeves, wherein each packaging sleeve has a front side and a rear side, wherein the front side and the rear side of each packaging sleeve are separated from each other by means of folding edges, along which the packaging sleeve is folded flat, wherein each packaging sleeve has two openings which are arranged on opposite sides of the packaging sleeve, and wherein each packaging sleeve has a longitudinal seam which connects two edges of the composite material to form a circumferential packaging sleeve, wherein the outer packaging is produced from a plastics material film and that the plastics material film has at least one weld seam which extends in a stacking direction, and wherein the plastics material film has stretch properties with an elongation at break of at least 100% and shrinking properties with a shrink value of at least 5%, and wherein the elongation at break in a transverse direction is at least 50% higher than in a longitudinal direction.

2. The bundle according to claim 1, wherein the outer packaging assembles the packaging sleeves in such a manner that in the stacking direction at least 4.0 packaging sleeves per cm are arranged.

3. The bundle according to claim 1, wherein the packaging sleeves are arranged in the outer packaging in such a manner that the longitudinal seams of all the packaging sleeves extend parallel with each other.

4. The bundle according to claim 1, wherein the packaging sleeves are arranged in the outer packaging in such a manner that the longitudinal seams of all the packaging sleeves are arranged in a common plane which extends in the stacking direction.

5. The bundle according to claim 1, wherein the packaging sleeves are arranged in the outer packaging in such a manner that the front sides of all the packaging sleeves face in the same direction and the rear sides of all the packaging sleeves face in the same direction.

6. The bundle according to claim 1, wherein the packaging sleeves are folded flat along both folding edges through an angle of approximately 180°.

7. The bundle according to claim 1, wherein the two folding edges extend parallel with each other.

8. The bundle according to claim 1, wherein the packaging sleeves are folded exclusively along the two folding edges.

9. The bundle according to claim 1, wherein the packaging sleeves have base faces and gable faces which are arranged at opposite sides of the two side faces, the front face and the rear face.

10. The bundle according to claim 1, wherein the composite material of the packaging sleeves has a strength in the range between 150 $g/m^2$ and 500 $g/m^2$.

11. The bundle according to claim 1, wherein the composite material of the packaging sleeves has a thickness in the range between 0.25 mm and 0.75 mm.

12. The bundle according to claim 1, wherein the composite material has at least one layer of paper, card or cardboard which is covered at the edge of the longitudinal seam extending inside the packaging sleeve.

13. The bundle according to claim 1, wherein the composite material is peeled in the region of the longitudinal seam.

14. The bundle according to claim 1, wherein the plastics material film has a thickness in the range between 10 μm and 50 μm.

15. The bundle according to claim 1, wherein the plastics material film is multi-layered.

16. The bundle according to claim 1, wherein the plastics material film surrounds the packaging sleeves in an undulating manner at least in the region of the folding edges.

17. The bundle according to claim 1, wherein the plastics material film has at least one welded end.

18. The bundle according to claim 1, wherein the plastics material film comprises a printing.

* * * * *